US005881650A

United States Patent [19]

Gersemsky et al.

[11] Patent Number: 5,881,650

[45] Date of Patent: Mar. 16, 1999

[54] RUNNING MECHANISM FOR CHAIN HOISTS, LOAD CARRYING MEANS FOR TRAILING CABLE

[75] Inventors: Udo Gersemsky, Herdecke; Hartmut Schütt, Wetter, both of Germany

[73] Assignee: Mannesmann Aktiengesellschaft, Düsseldorf, Germany

[21] Appl. No.: 843,698

[22] Filed: Apr. 16, 1997

[30] Foreign Application Priority Data

| | | | |
|---|---|---|---|
| Apr. 19, 1996 | [DE] | Germany | 196 17 119.9 |
| May 9, 1996 | [DE] | Germany | 196 20 145.4 |

[51] Int. Cl.[6] ..... B61B 3/00

[52] U.S. Cl. ..... 105/154; 105/148; 104/95

[58] Field of Search ..... 105/148, 150, 105/154, 155; 104/89, 93, 94, 95; 16/87 R, 91, 96 R, 97, 103, 106, 107

[56] References Cited

U.S. PATENT DOCUMENTS

| | | | |
|---|---|---|---|
| 911,221 | 2/1909 | Ellsworth | 105/154 |
| 1,151,226 | 8/1915 | Steedman | 105/154 |
| 1,646,217 | 10/1927 | Richter | 105/154 |
| 2,611,326 | 9/1952 | Smallpeice | 105/154 |
| 2,645,187 | 7/1953 | Guadagna | 105/154 |
| 2,744,472 | 5/1956 | Symons | 105/154 |
| 3,774,548 | 11/1973 | Borst | 104/95 |
| 4,271,927 | 6/1981 | Brown et al. | 105/154 |
| 4,715,288 | 12/1987 | Catena | 105/154 |
| 5,664,502 | 9/1997 | Wilhelm | 105/150 |

FOREIGN PATENT DOCUMENTS

| | | | |
|---|---|---|---|
| 2 318 009 | 2/1977 | France . | |
| 1 927 583 | 11/1965 | Germany . | |
| 1 939 084 | 5/1966 | Germany . | |
| 30 30 929 | 3/1982 | Germany . | |
| 494 451 | 3/1990 | Germany . | |
| 41 09 971 | 9/1992 | Germany . | |
| 42 09 565 | 9/1993 | Germany . | |
| 458887 | 8/1950 | Italy | 105/154 |
| 12819 | 1/1924 | Netherlands | 105/154 |
| 10272 | 4/1911 | United Kingdom | 105/154 |

*Primary Examiner*—Mark Tuan Le

*Attorney, Agent, or Firm*—Cohen, Pontani, Lieberman & Pavane

[57] ABSTRACT

A running mechanism which travels on a running rail comprising a web and a flange. Running wheels are supported by the flange on opposite sides of the web and are rotatably mounted in frame parts which are connected by an articulation arranged below the running rail such that the frame parts swivel open or closed laterally about a swivel pin. A load acts on at least one of the frame parts at the height of or below the swivel pin and holds the frame parts swiveled closed towards the web on both sides by means of a closing moment generated by the load. Guide rollers, one of which is rotatably supported in the frame part, are supported on opposite sides of the web.

13 Claims, 7 Drawing Sheets

RUNNING MECHANISM FOR CHAIN HOISTS, LOAD CARRYING MEANS FOR TRAILING CABLE

BACKGROUND OF THE INVENTION

1. Field of the Invention

The invention is directed to a traveling gear or running mechanism, and in particular a running mechanism for chain hoists, load carrying means or trailing cable.

2. Description of the Related Art

A running mechanism with two frames arranged so as to be swivelable with respect to one another and with rotatably mounted running rollers which are supported by the flange parts and the web of the running rail is disclosed in German patent publication 494 451. The running rollers substantially run in channels, i.e., in the round transitional regions between flange and web which guide the running mechanism. Thus, the running rollers accomplish the twofold task of carrying and guiding the running mechanism with the load. The frames are connected with one another in an articulated manner by a transverse support by a pin at one end of the transverse support. The distance between these swivel pins is selected so that the running wheels run in the channels of the rails without problems. In order to improve the guidance of the running mechanism, a guide roller is provided underneath the rail which rolls along the outer side of the lower flange of the rail and comes into contact with it under the influence of applied force. One side of the swivel pin of the guide roller is connected to a gear unit to drive the running mechanism. The guide roller performs two functions, a driving function and a guiding function. A disadvantage of this known running mechanism is that the running rollers and the driving roller simultaneously used to guide the running mechanism require a specially designed running mechanism construction which is relatively expensive to assemble and which requires a rail adapted to the running mechanism for trouble-free running.

German patent publication 41 09 971 A1 discloses a running mechanism with running wheels on both sides of an I-shaped running rail contacted on one side by front and rear lateral guide rollers which are mounted on vertical axles. This running mechanism also travels on the support rail in a stable manner in the case of loads swinging in a pendulum-like manner. Nevertheless, the running stability of this running mechanism is limited, in that during critical situations the running mechanism has a tendency to pitch and rock in a pendulum-like manner. Moreover, the running mechanism has a relatively complex construction, is expensive to manufacture and is difficult to mount on the support.

Another running mechanism is disclosed in German patent publication 42 09 565 A1 as including a crane trolley with a lifting mechanism of compact overall height having running wheels which run on the lower flange of a rail and are supported by a supporting frame part. One of the running wheels of this lower flange crane trolley is driven and supported by a rocker which is arranged on the supporting frame part so as to be swivelable. A friction wheel is arranged on the rocker which contacts the lower flange of the rocker from below and is in a driving connection with the driven running wheel. An adjustable eccentric ensures uniform contact of all running wheels at the lower flange. This crane trolley is advantageous for situations in which extensive reinforcement by frictional engagement is required; however, it is disadvantageous in that it requires a relatively high assembly cost for mounting the crane trolley on the support and is not suitable for use with different web thicknesses and flange widths.

Another crane trolley with at least one running wheel is disclosed in German patent publication 30 30 929 A1. This crane trolley is provided with laterally arranged guide rollers which contact vertical guide surfaces of a rail carrier arranged one above the other. The upper guide rollers together with the lower guide rollers effectively prevent a tilting of the crane trolley at the rail carrier, and the front guide rollers together with the rear guide rollers ensure defect-free guiding of the crane trolley in the longitudinal direction of the rail carrier. This crane trolley is disadvantageous in that it is relatively expensive to mount on the support despite the small number of individual parts. In addition, the relatively small intermediate space, approximately 1 mm, between the guide surfaces and the guide rollers does not provide adequate compensation for tolerances so as to ensure trouble-free parallel running of the running rollers.

Thus, it is desirable to provide a running mechanism which is capable of automatically adapting to different web thicknesses yet be readily assembled and not have a tendency to rock from side-to-side even when the load swings in a pendulum-like manner.

SUMMARY OF THE INVENTION

The present invention is directed to a running or driving mechanism, and in particular a running mechanism for chain hoists, load carrying means or trailing cable. The running mechanism travels on a running rail comprising at least a web and a flange. Running wheels are supported by the flange opposite to the web and are rotatably mounted in frame parts which are connected below the running rail such that they swivel open or closed laterally about a swivel pin which extends below the running rail in the direction of the running rail. A load suspension device is arranged on at least one frame part. A load acts on at least one of the frame parts at the height of or below the swivel pin so as to pass through the latter and holds the frame parts so as to be swiveled in at the web on both sides by means of a closing moment produced by the load and as a result of a guide. The guide comprises two guide rollers which are supported on opposite sides at the web. One of the guide rollers is rotatably supported in a frame part. The two frame parts are connected to one another in an articulated manner by an articulation by an individual stationary swivel pin. The articulation formed below the running rail by the stationary swivel pin simultaneously provides the suspension means for the suspended load.

The running mechanism of the present invention is advantageous in that it may be suspended in the preassembled state along a running rail with few or limited hand manipulation. The running rail comprises at least one flange and a web. Guide rollers contact both sides of the web and adjust automatically, without play, to ensure an approximately steady and approximately parallel running of the running wheels which reduces the rolling resistance and, in turn, reduces the wear of the running wheel. In addition, the present inventive running mechanism construction reduces the wear of the guide rollers. The amount of wear effects the running resistance, and thus the reduced effect of wear reduces the running resistance so that the running mechanism requires a smaller expenditure of energy. Construction of the running mechanism so that it remains held in a closed position by the load is advantageous, especially on curves, in that it ensures approximately parallel running of the running rollers. Continuous contact of the guide rollers ensures relatively stable guiding of the running mechanism regardless of swinging of the load in a pendulum-like manner. A relatively large tolerance range of variations in the diameter of the running wheels and guide rollers as a result of inevitable wear are compensated for because the present inventive running mechanism adapts to the running rail automatically.

The present running mechanism is advantageous in that it requires a relatively small number of structural components dimensioned so as to achieve relatively high mechanical stability. In particular, the running mechanism comprises swivelably jointed frame parts and centrally arranged thereto are at least two oppositely located running wheels and pairs of guide rollers with a vertical axis of rotation disposed in front of and behind the running wheels. The running wheels are supported on the flanges and the pairs of guide rollers contact both sides of the web of the running rail when a load is applied to the running mechanism. Thus, relatively smooth travel along curves is ensured even when only two running wheels are used.

The frame parts are constructed in such a way that the frame parts with the running wheels and with the guide rollers arranged in pairs may be swiveled over the lower flange of the running rail to the extent that there is ruling clearance or running play between the running surface of the lower flange of the running rail and the directly opposite surface of the frame part. Therefore, the running mechanism exhibits relatively high stability when the running wheels move in the vicinity of the web.

Advantageous structural dimensions with a relatively small number of structural components and relatively low costs are achieved when the articulator or joint or hinge arranged below the running rail simultaneously provides the suspension means for the suspended load.

In another embodiment, the running mechanism is readily adaptable to accommodate different web thicknesses, that is the angular position between the frame parts for the running wheels and for the guide rollers, respectively, is adjusted using an adjustable spacing means, as for example a stop with an adjusting screw. In this embodiment, a portion of the closing force resulting from the load is absorbed by the running mechanism itself.

The running mechanism in an alternative embodiment or modification includes frame parts which are constructed so as to be adaptable to different inclinations of the flange. In particular, two bores or holes are provided in the frame parts in the region of the articulator. The frame parts may be adjusted between two different angular positions as defined by the bores and secured therein by a screw that extends through both frame parts. Thus, the present inventive running mechanism is suitable for an able to accommodate typical or frequent situations employing a single cylindrical standard roller.

A compact and robust running mechanism with a relatively simple drive assembly is achieved when one of the two running wheels is driven directly by a motor. The drive is preferably constructed so as to be substantially maintenance-free. In addition, the running stability of the running mechanism may be improved by arranging the running wheel or wheels of one frame part so as to be offset in the traveling direction relative to the running wheel of the other frame part.

The running mechanism is preferably constructed so that the guide rollers project outwardly from the frame part in the running direction. In this configuration the guide rollers act as a buffer when the running mechanism reaches an end stop and eliminates the need for additional buffers, as for example manufactured from plastic or rubber.

Similarly constructed right-hand and left-hand frame parts may be used. The ends of the frame parts which form the articulation may be constructed to be fork-shaped and arranged axially offset of the swivel pin. The ends of the frame parts are connected to one another by a central screw in an articulated manner by an articulation.

A substantially rigid connection which is approximately rotation-free may be achieved by defining a hexagonally-shaped recess in the ends of the frame parts for receiving a hexagonal screw.

The running mechanism may be made more compact by supporting the load on the screw by a suspension shackle. Moreover, the suspension shackle may also be provided with a cross-hole so that the load suspension device is readily fastenable at an approximately 90 degree rotation.

In order to safeguard against unwanted swinging of the frames to an open position, e.g., when the load is withdrawn, and to facilitate the suspension of the running mechanism at the running rail, a snap lock may be included so as to maintain the running wheels and guide rollers in an approximately fixed position. The snap lock acts in the operating position between the two frame parts supporting the running wheels and the guide rollers such that it locks in automatically with respect to swinging closed but can only be released manually with respect to swinging open. In a preferred construction, the snap lock comprises a spring locking element with a pin which projects through a free hole in the frame part and engages or locks in a recess of the oppositely located frame part.

The present inventive running mechanism achieves a substantially uniform load distribution, that is the load acts on at least one of the frame parts approximately centrally with respect to the running rail.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference numerals denote similar elements throughout the several views.

DETAILED DESCRIPTION OF THE PRESENTLY PREFERRED EMBODIMENTS

Figure 1:
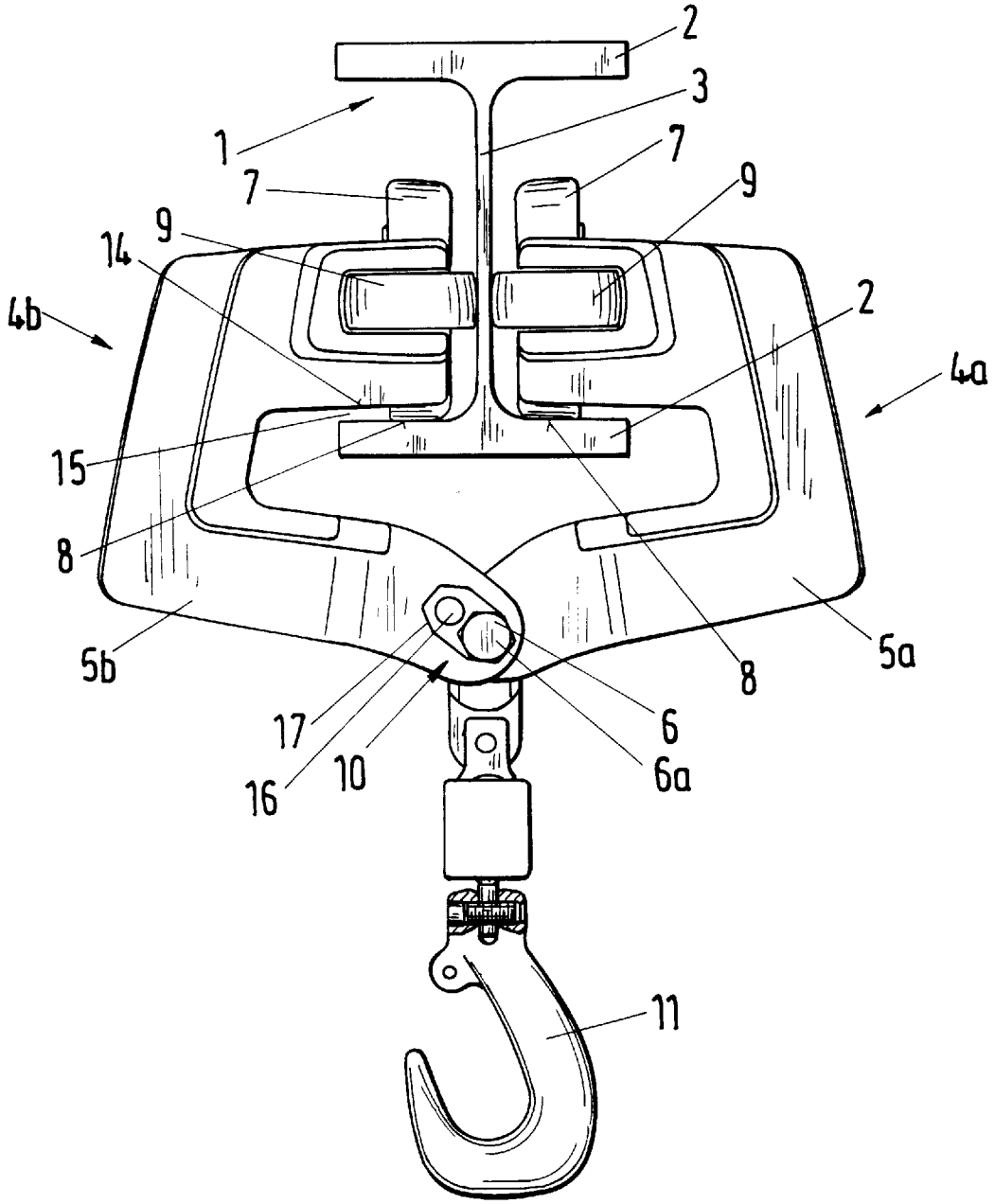
FIG. 1 depicts a front view of a running mechanism of the present invention.

FIG. 1 shows a front view of a running mechanism of the present invention comprising a running rail 1 including two flanges 2, e.g., an upper flange and a lower flange, and a web 3 interposed between the upper and lower flanges. The running mechanism itself has two wheel support arms 4*a*, 4*b* comprising two frame parts 5*a*, 5*b*. Frame parts 5*a*, 5*b* are jointed in the region of their respective ends so as to swivel about a swivel pin 6 which is disposed below the running rail 1 and extends in the direction of the running rail 1. The frame parts 5*a*, 5*b* swivel open and closed about the swivel pin. A pair of running wheels 7 is disposed on opposite sides of the web 3 in the upper region of the frame parts 5*a*, 5*b*. The running wheels 7 are mounted in an axial direction to the frame parts 5*a*, 5*b* and rotate about horizontal axes of rotation. One of the two running wheels 7 is directly driven by a motor 20 (see FIG. 2). The running wheels 7 roll on running surfaces 8 of the lower flange 2.

Guide rollers 9 are mounted to the frame parts 5*a*, 5*b* and arranged in pairs in front of and behind the running wheels 7 so as to be rotatable about vertical axes of rotation. The running wheels 7 are supported by the running surfaces 8 of the lower flange 2 while each pair of the guide rollers 9 contacts both sides of the web 3 of the running rail 1. The frame parts 5*a*, 5*b* swivel inward or closed over the respective lower flange 2 of the running rail 1 until the running wheels 7 are disposed in the immediate vicinity of the web 3. A load applied to a load hook 11 acts on the swivel pin 6 at the height of the articulation 10 of the two interconnected frame parts 5*a*, 5*b* and as a result, the articulation 10 forms a suspension means for the suspended load. Of course, other load suspension arrangements may be used and are within the intended scope of the invention. It is, however, essential for the load to act on at least one of the frame parts 5*a* or 5*b* approximately centrally with respect to the running rail 1 and at approximately the same height as or below the articulator 10 which connects the frame parts 5*a*, 5*b* to one another.

Figure 2:
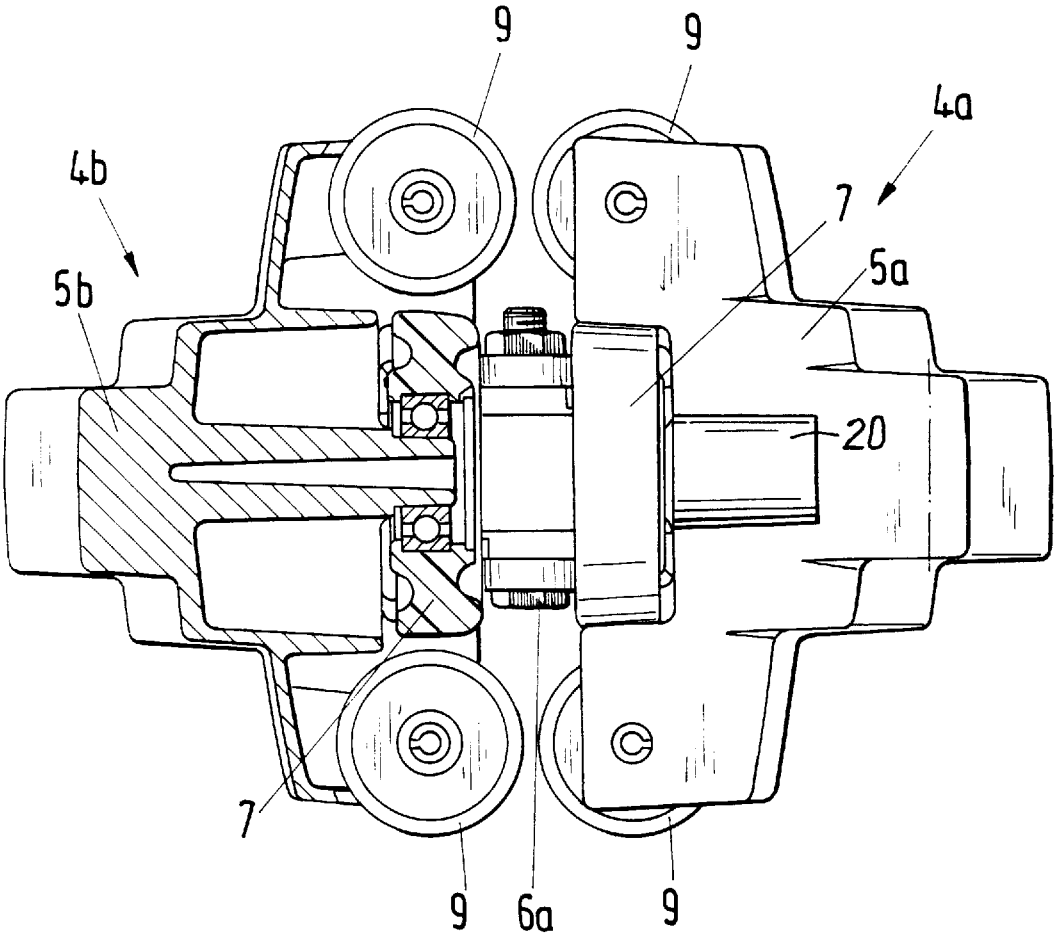
FIG. 2 depicts a partial section top view of the running mechanism of FIG. 1 without the running rail.

The load generates a closing moment in the frame parts 5*a*, 5*b* which causes the frame parts 5*a*, 5*b* to swivel closed and the guide rollers 9 to remain or be held in contact with the web 3 of the running rail 1. An angular position between the frame parts 5*a*, 5*b* is defined, as shown in FIG. 1, by the guide rollers 9 contacting both sides of the web 3 when the load is applied to or supported by the load hook 11. FIG. 2 shows a partial section top view of the running mechanism of FIG. 1 with the running rail omitted.

Figure 3:
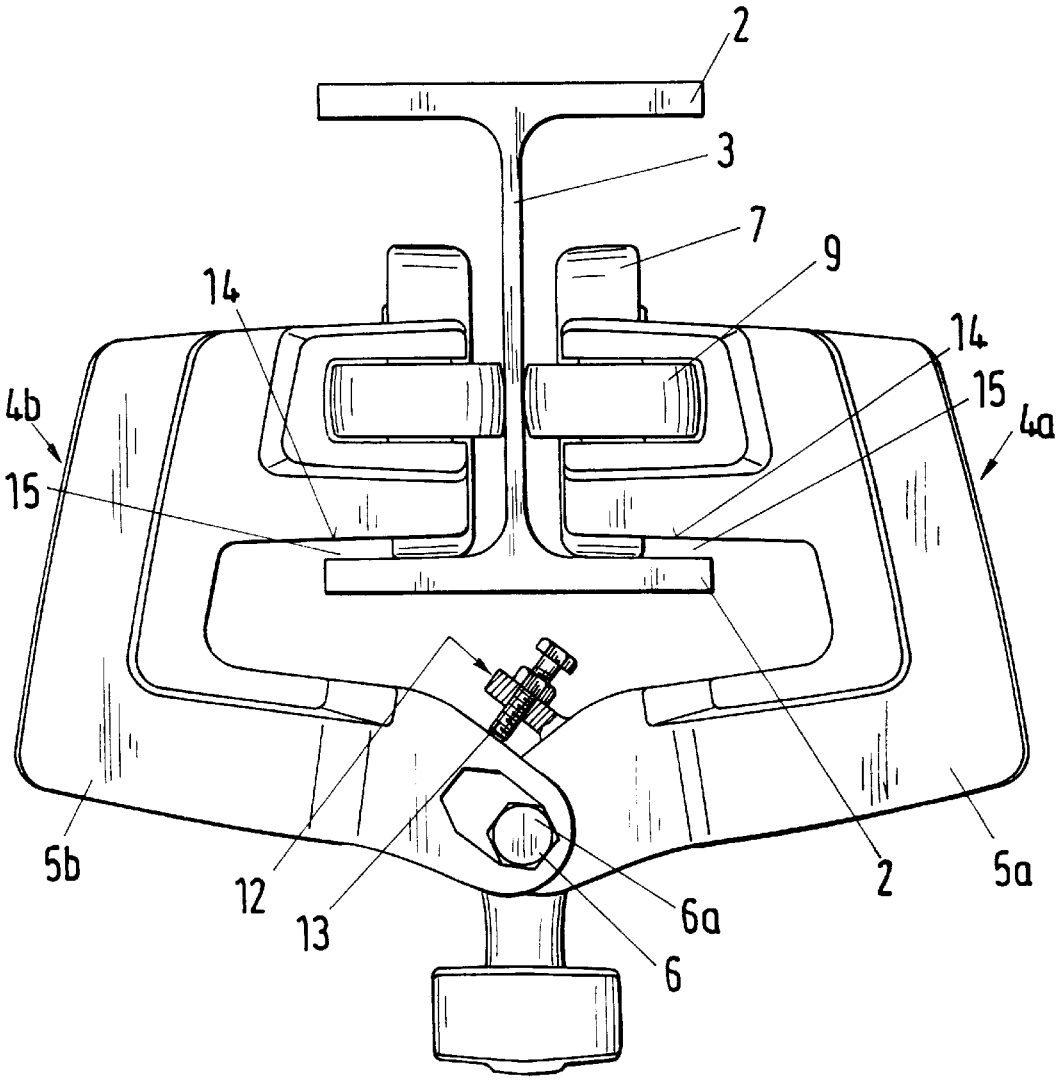
FIG. 3 depicts a front view of the running mechanism of the present invention with a stop.
Figure 3A:
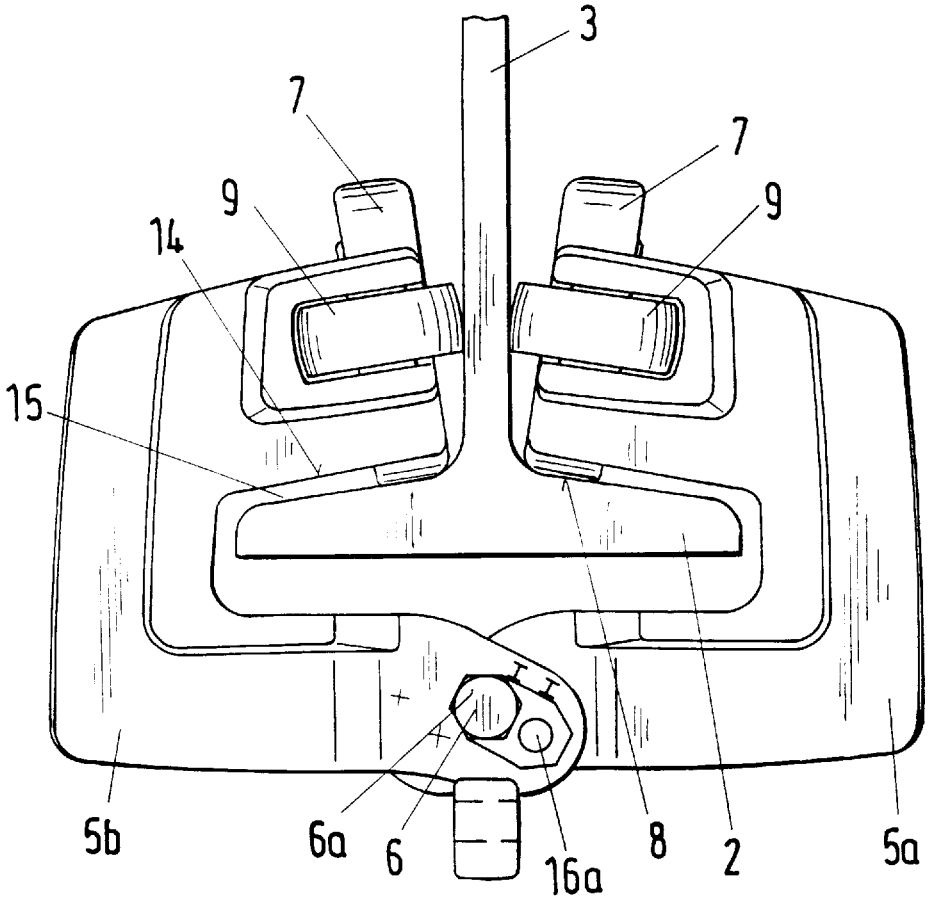
FIG. 3A depicts a front view of the running mechanism of the present invention with inclined flanges.

FIG. 3A depicts a front view of an alternate embodiment of the running mechanism of the present invention in which the angular position between the frame parts 5*a*, 5*b* for the running wheels 7 and for the guide rollers 9, respectively, is adjustable by means of an adjustable spacing means 12. The preferred spacing means 12, as shown in FIG. 3A, is a stop 13 with an adjusting screw. In addition to adjusting the angular position between the frame parts 5*a*, 5*b*, the stop 13 causes the closing moment resulting from the load to be substantially absorbed by the running mechanism itself.

FIGS. 1 and 3A show a running play or clearance 15 between the running surface 8 of the lower flange 2 of the running rail 1 and a surface 14 directly opposite thereto. In a preferred embodiment, the running play 15 is approximately 1 mm. The running play prevents the running mechanism from falling down in the event of wheel breakage and prevents shearing due to falling. Moreover, the running play 15 makes it possible to use the running mechanism as a suspension claw, enabling a relatively simple exchange of the running wheels 7, as for example, by means of a support plate inserted into the gap or space defined by the running play 15.

Figure 2A:
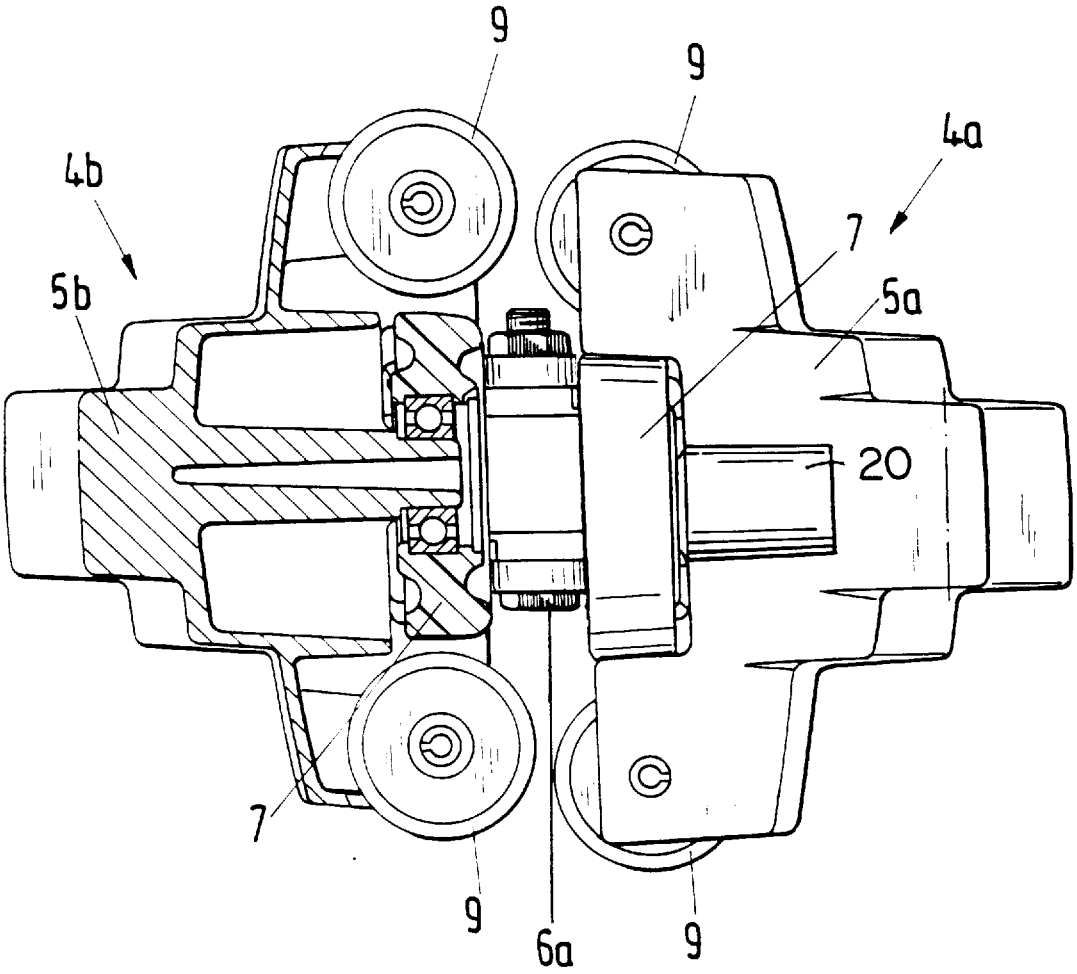

In the region of the articulator or joint or hinge 10, the frame parts 5*a*, 5*b* are provided with two bores or holes 16, 16*a* approximately parallel to the swivel pin 6, as shown in FIGS. 1 and 3B. The second bore or hole defines a second angular position of the frame parts 5*a*, 5*b* with the swivel pin 6 offset axially so as to adapt or modify the running mechanism construction when the lower flange is inclined. FIG. 3B shows a running mechanism with the swivel pin 6 inserted into the second bore or hole 16 which enables optimum adaptation to the flange inclination of the running rail 1. It should be noted that although two bores or holes are shown and described any number of desired bores or holes may be used. In an alternative embodiment or modification, the running wheel 7 of a frame part 5*a* or 5*b* is offset relative to the running wheel 7 of the other frame part 5*b* or 5*a* which increases the position stability when the load is being transported (see FIG. 2A).

As is also evident from FIG. 2, the guide rollers 7 are preferably arranged so that they project outwardly from the frame part 5*a*, 5*b* in the movement direction and form a buffer toward an end stop (not shown) to thereby eliminate the need for an additional buffer, as for example a rubber or plastic buffer.

Figure 4:
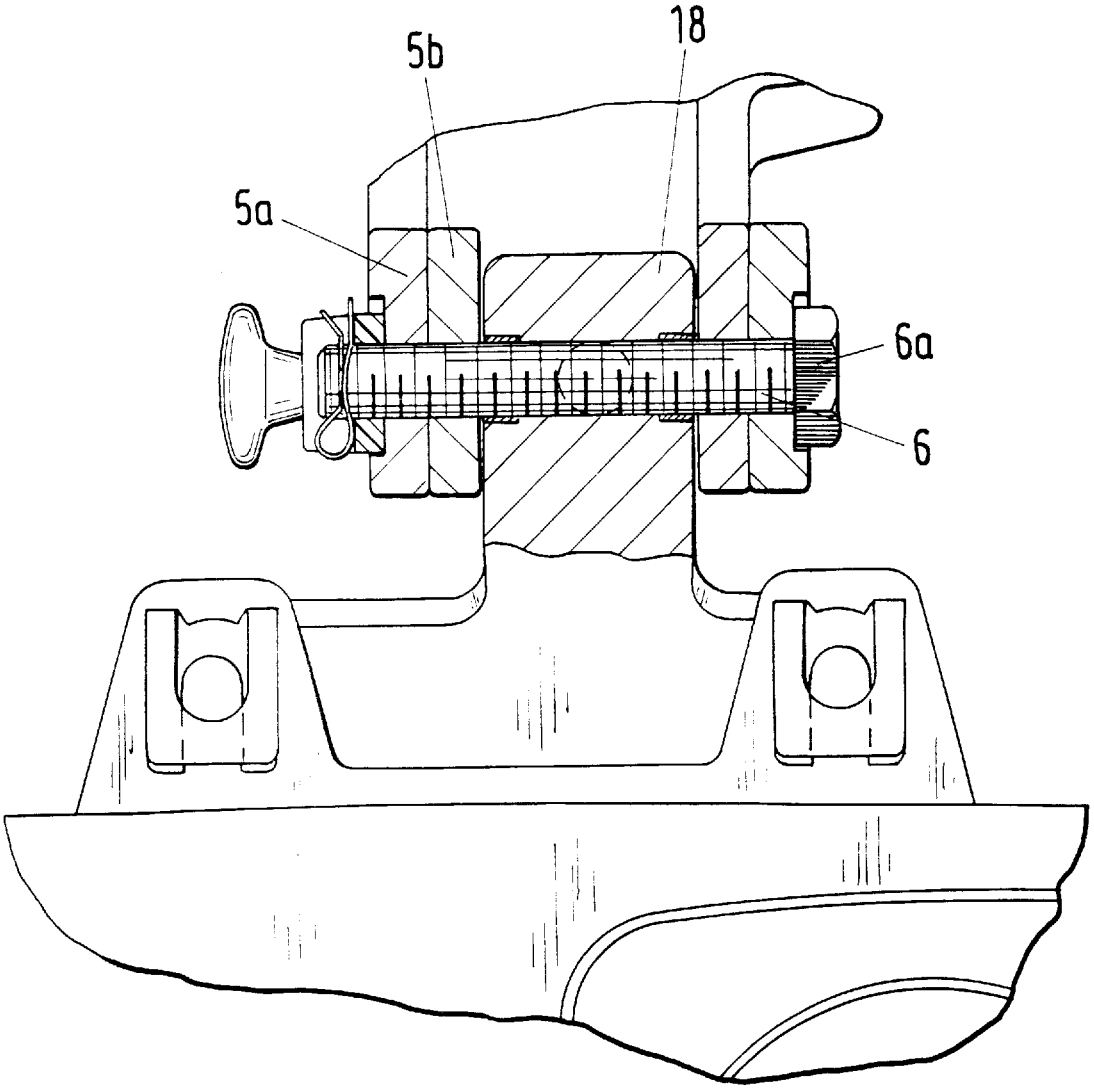
FIG. 4 depicts a partial section side view of the swivel pin of the running mechanism of FIG. 1.

The two frame parts 5*a* and 5*b* are forked in that they comprise two branches diverging from the articulation 10. The two forked frame parts 5*a*, 5*b*, as shown in FIGS. 1 and 3A, are similarly constructed and their ends are arranged on the swivel pin 6 so as to be offset axially (see FIG. 5 for example. A recess 17 is preferably defined in the ends of the frame parts 5*a*, 5*b* to receive a screw 6*a* which secures the frame parts 5*a*, 5*b* together in an articulated manner. In a preferred embodiment the recess and screw are both hexagonally-shaped, however, any other shape recess and screw are contemplated and within the intended scope of the invention. The load may be supported by a suspension shackle 18 on the screw 6*a*, as shown in FIG. 4.

Figure 5:
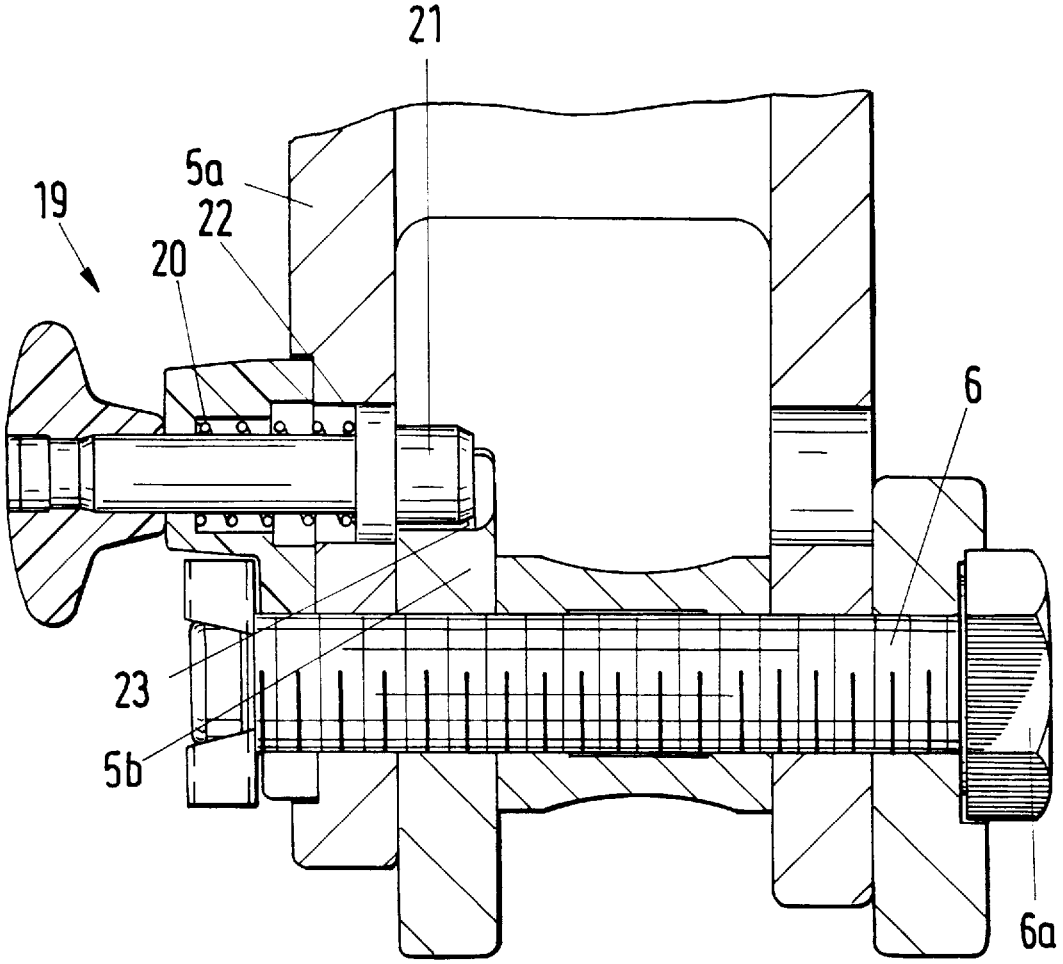
FIG. 5 depicts a cross-sectional view of a snap lock of the running mechanism of the present invention.

FIG. 5 shows a cross-sectional view of the screw connection effected by screw 6*a*. A snap lock 19 safeguards against unwanted swiveling and opening of the running mechanism when the load is withdrawn. The snap lock 19 locks automatically when the frame parts 5*a*, 5*b* swivel closed, and must be disengaged or released manually in order to swivel the frame parts 5*a*, 5*b* open. In a preferred construction, the snap lock 19 comprises a spring lock element 20 and a pin 21. During operation, the pin 21 projects into a recess 23 of the inner frame part 5*b* so as to penetrate a bore or hole 22 of the outer frame part 5*a* and is held therein.

In a preferred embodiment, the ratio of the vertical distance of the axis of rotation of the running wheels 7 and the horizontal distance of the running wheels 7 from the swivel pin 6 is between approximately 3 and 10.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same way to achieve the same results are within the scope of the invention. Substitutions of elements from one described embodiment to another are also filly intended and contemplated. It is also to be understood that the drawings are not necessarily drawn to scale but that they are merely conceptual in nature. It is the intention, therefore, to be limited only as indicated by the scope of the claims appended hereto.

We claim:

1. A running mechanism for operative interactive movement along a running rail including an upper subtantially horizontal flange disposed above a lower substantially horizontal flange and a web substantially vertically extending between the upper flange and the lower flange, said running mechanism comprising:

two frame parts jointly connected to one another below the running rail by a swivel pin disposed below the running rail and extending in a direction of the running rail through an end of each of said frame parts thereby defining an axis of rotation about which said frame parts laterally swivel open and closed with respect to one another;

a running wheel rotatatively mounted on each of said frame parts and disposed so as to be supported by the lower flange on opposite sides of the web; and a guide roller rotatively mounted on each of said frame parts on opposite sides of the web;

said frame parts being swiveled closed and said guide rollers contacting opposite sides of the web in response to a closing moment produced by a load being applied to one of said frame parts.

2. The running mechanism in claim 1, wherein said lower flange of said running rail has a running surface and said frame parts have a surface opposite said running surface and wherein said frame parts with said running wheels and said guide rollers are swiveled over said lower flange of the running rail so that there is clearance between the running surface of the lower flange of the running rail and the directly opposite surface of said frame parts.

3. The running mechanism in accordance with claim 1, further comprising an adjustable spacing means for defining an angular position of said frame parts with respect to one another.

4. The running mechanism in accordance with claim 2, wherein said running surface of said lower flange is inclined and said frame parts have two bores defined therethrough providing two different angular orientations of said frame parts, said frame parts being secured by a screw extending through both of said frame parts and one of the bores.

5. The running mechanism in accordance with claim 1, wherein one of said running wheels is directly driven by a motor.

6. The running mechanism in accordance with claim 1, wherein said running wheel of one of said frame parts is disposed so as to be offset in a direction of travel relative to said running wheel of said other frame part.

7. The running mechanism in accordance with claim 1, wherein said guide rollers are disposed so as to protrude outwardly from said frame part in a direction of travel providing a buffer at an end stop.

8. The running mechanism in accordance with claim 1, wherein said two frame parts are forked at the swivel pin and disposed offset axially on the swivel pin.

9. The running mechanism in accordance with claim 4, wherein the screw is hexagonally-shaped and the ends of said frame parts have a hexagonal recess defined therein for receiving the screw.

10. The ruing mechanism in accordance with claim 4, further comprising a suspension shackle disposed about the screw for supporting the load.

11. The running mechanism in accordance with claim 1, further comprising a snap lock operative between said two frame parts, said snap lock locking automatically when said frame parts swing closed and manually disengageable for permitting said frame parts to swing open.

12. The running mechanism in accordance with claim 11, wherein said snap lock comprises a spring lock.

13. The running mechanism in accordance with claim 1, further comprising means for applying a load on at least one of said frame parts approximately centrally with respect to the running rail.

* * * * *